United States Patent [19]

Kaminaga

[11] Patent Number: 4,571,905

[45] Date of Patent: Feb. 25, 1986

[54] METHOD OF MOUNTING CURTAIN WALL UNITS AND CONSTRUCTIONS THEREOF

[75] Inventor: Hiromitsu Kaminaga, Kurobe, Japan

[73] Assignee: Yoshida Kogyo K.K., Tokyo, Japan

[21] Appl. No.: 600,178

[22] Filed: Apr. 13, 1984

[30] Foreign Application Priority Data

Apr. 18, 1983 [JP] Japan ..... 58-56757
Apr. 18, 1983 [JP] Japan ..... 58-67110

[51] Int. Cl.[4] ..... E04B 2/88

[52] U.S. Cl. ..... 52/235; 52/403; 52/506; 52/509; 52/378

[58] Field of Search ..... 52/235, 393–403, 52/509, 512, 506, 478, 486, 489, 588, 593, 594, 378; 285/191

[56] References Cited

U.S. PATENT DOCUMENTS

| | | | |
|---|---|---|---|
| 3,052,330 | 9/1962 | Hammitt et al. | 52/403 X |
| 3,466,826 | 9/1969 | Gallagher et al. | 52/235 X |
| 3,553,918 | 1/1971 | Dauson | 52/235 X |
| 3,936,986 | 2/1976 | Steel | 52/235 |
| 3,940,897 | 3/1976 | Stoakes | 52/397 X |
| 3,956,863 | 5/1976 | Tiedeken | 52/399 |
| 4,458,745 | 7/1984 | Gartner | 285/191 X |
| 4,483,122 | 11/1984 | Crandell | 52/235 X |

FOREIGN PATENT DOCUMENTS

| | | | |
|---|---|---|---|
| 8272 | 2/1980 | European Pat. Off. | 52/235 |
| 2006641 | 8/1971 | Fed. Rep. of Germany | 52/235 |
| 2305394 | 8/1974 | Fed. Rep. of Germany | 52/235 |
| 2364224 | 11/1975 | Fed. Rep. of Germany | 52/235 |
| 2428754 | 12/1975 | Fed. Rep. of Germany | 52/235 |
| 1293557 | 4/1962 | France | 52/235 |

*Primary Examiner*—Donald G. Kelly
*Assistant Examiner*—Richard E. Chilcot, Jr.
*Attorney, Agent, or Firm*—Hill, Van Santen, Steadman & Simpson

[57] ABSTRACT

In order to assemble a unit type curtain wall, curtain wall units are successively mounted by the steps of positioning a lower edge portion of a curtain wall unit to be mounted relative to an upper edge portion of an existing curtain wall unit positioned therebelow in a direction orthogonal to a curtain wall surface to provisionally connect them together, moving the unit in a direction parallel to the curtain wall surface to connect with another existing curtain wall unit positioned to left or right, and thereafter perpendicularly moving the curtain wall unit to be mounted so as to be secured to a building body and the existing curtain wall units.

1 Claim, 7 Drawing Figures

METHOD OF MOUNTING CURTAIN WALL UNITS AND CONSTRUCTIONS THEREOF

BACKGROUND OF THE INVENTION

1. Field of the Invention

The present invention relates to a method of mounting curtain wall units in a unit type curtain wall in which curtain wall units are continuously mounted upwardly, downwardly, leftwards and rightwards externally of rooms of a building body, and apparatus thereof.

2. Description of the Prior Art

In mounting curtain wall units externally of rooms of a building body, it is customary to pull up the curtain wall units by means of a crane or the like to mount them in the state wherein they are assembled. However, since the curtain wall units are heavy and bulky, it is extremely difficult and cumbersome to and involves a danger to locate the units in a direction orthogonal to and in a direction parallel to the curtain wall surface in the state wherein the units are pulled up.

In view of the foregoing, it has been heretofore proposed a mounting apparatus in which downwardly-directed hook portions of mounting members secured to the curtain wall units are locked at supporting members secured to the building body, and thereafter, the supporting members and mounting members are connected by welding, bolts and nuts and the like, as disclosed in Japanese Utility Model Publication No. 33058/76 and Japanese Patent Publication No. 11976/82.

However, according to the above-described mounting apparatus, when the supporting members and mounting members are brought into engagement with one another, the curtain wall units swing outwardly in the direction orthogonal to the curtain wall surface, and therefore, it is difficult to bring the supporting members and mounting members into engagement with one another, resulting in the engaging work being difficult and cumbersome. In addition, as the curtain wall units are connected with existing curtain wall units positioned on left-hand and right-hand, they have to be moved in the direction parallel to the curtain wall surface, in which case, however, if the supporting members and mounting member become engaged with one another, it is difficult to move the curtain wall units in the direction parallel to the curtain wall surface and the connecting work with the existing curtain wall units positioned on left-hand and right-hand becomes cumbersome.

Particularly where a seal member is provided on an upper portion of a lower curtain wall unit and a fitting groove for the seal member is formed in a lower portion of an upper curtain wall unit whereby the seal member and fitting groove are fitted so as to seal a connected portion between the upper and lower curtain wall units, when the curtain wall units swing outwardly in the direction orthogonal to the curtain wall surface, the seal member is hard to coincide with the fitting groove, resulting in bending or breakage of the seal member, and when the seal member and fitting groove become fitted, it becomes difficult to move the curtain wall units in the direction parallel to the curtain wall surface.

SUMMARY OF THE INVENTION

The present invention has been achieved in view of the above-described circumstances.

It is an object of the present invention to provide a method of mounting curtain wall units and constructions thereof in which to existing curtain wall units already mounted fixedly to the building body and utilized as a reference are connected successive curtain wall units in an extremely simple manner, and the units may be fixed simply even to a building body.

To achieve the above-described object, according to a first feature of the present invention, there is provided a method of curtain wall units characterized by the steps of positioning a lower edge portion of a curtain wall unit to be mounted relative to an upper edge portion of an existing curtain wall unit positioned therebelow in a direction orthogonal to a curtain wall surface to provisionally connect them together, moving the unit to be mounted in a direction parallel to the curtain wall surface to connect with an existing curtain wall unit positioned on left-hand or right-hand, and thereafter perpendicularly moving the curtain wall unit to be mounted so as to be fixed to a building body and the existing curtain wall units.

To achieve the above-described object, according to a second feature of the present invention, there is provided a construction of mounting curtain wall units comprising hook means secured to the back of a mullion constituting a curtain wall unit, a supporting member secured to the front surface of a building body for engagement with said hook means, projecting members provided to be projected upwardly spaced apart from each other on an upper edge portion of the curtain wall unit and a seal member, a lower edge portion of the curtain wall unit having a groove at a position corresponding to said seal member and engaging therewith, and bracket means secured to said lower edge portion of the curtain wall unit and formed with an engaging portion at a position corresponding to said projecting member and engaging therewith, characterized in that said projecting member and seal member provided on the upper edge portion of a lower one of a pair of vertically adjacent curtain wall units are respectively engaged with the engaging portion of said bracket provided on the lower edge portion of the upper unit and the groove of the lower edge portion, said hook means being engaged with said supporting member.

According to the present invention, there is further provided a construction of mounting curtain wall units characterized in that in mounting the curtain wall units, let $L_1$ be the length in which the engaging portion of the bracket secured to the lower edge portion of the curtain wall unit engages and passes through the projecting member, $L_2$ be the length of engagement between the hook means and the supporting member, and $L_3$ the length of engagement between the seal member and the groove provided in the lower edge portion of the curtain wall unit, then the relation of $L_1 > L_2 L_3$ is established.

According to the present invention, there is further provided a construction of mounting curtain wall units characterized in that the engaging portion formed in the bracket secured to the lower edge portion of the curtain wall unit comprises an elongated hole extending in a direction parallel to the curtain wall surface, whereby the curtain wall unit to be mounted is moved in a direction parallel to the curtain wall surface.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE INVENTION

Figure 1:
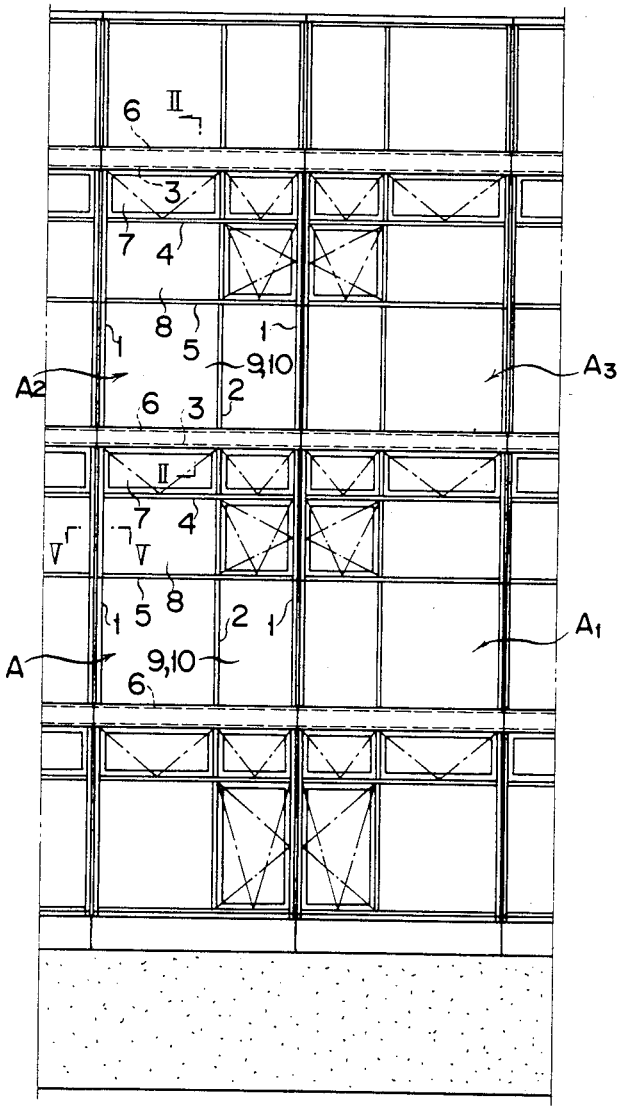
FIG. 1 is an overall schematic front view of a building with curtain wall units already mounted.
Figure 2:
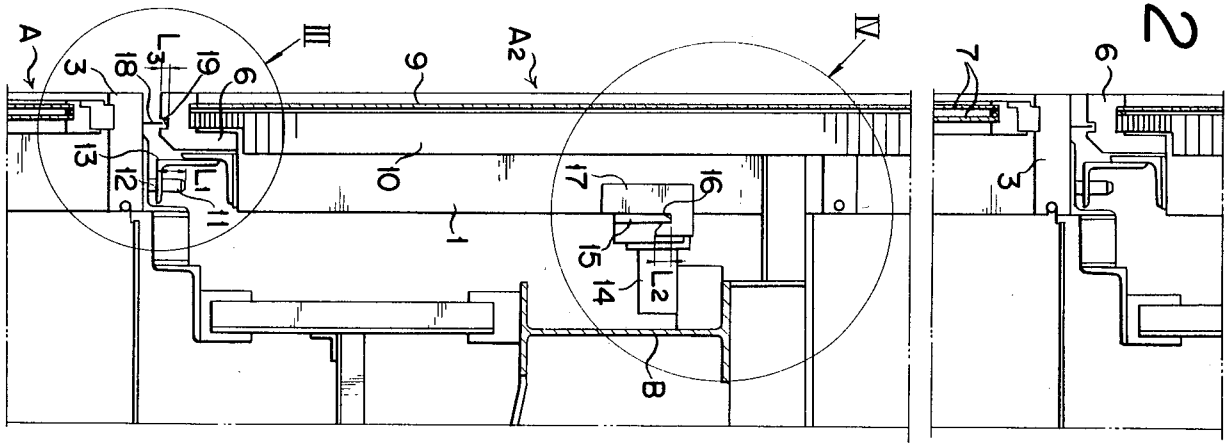
FIG. 2 is a sectional view taken on line II—II of FIG. 1.

FIG. 1 is an overall schematic front view showing a building in the state wherein curtain wall units are already mounted, and FIG. 2 is a sectional view taken on line II—II of FIG. 1. Externally of rooms of the building body, curtain wall units A, $A_1$, $A_2$, $A_3$, . . . are continuously mounted upwardly, downwardly, leftwards and rightwards to constitute a unit type curtain wall.

Each of curtain wall units has left and right mullions 1, 1 which form a vertical frame member, an upper horizontal member which forms a horizontal member between muntins 2, a transom 4, a middle transom 5, a square-shaped frame with a lower horizontal member laid horizontally, a window 7 in each frame, a double glazing panel 8, a glazing panel 9, and a panel member such as a heat insulating material fill-in panel (hereinafter merely referred to as a heat insulating panel), mounted thereon.

A pin 11 as a projecting member is stood upright on and secured to the upper horizontal member 3, a bracket 13 having a hole 12 as an engaging portion, into which the pin 11 is fitted, is fixedly mounted on the lower horizontal member 6, a supporting member 15 is provided on a building body B through a fastener 14, a hook 17 having a downwardly-directed recessed groove 16 in engagement with the supporting member is provided on the mullion 1, a seal member 18 is upwardly mounted on the edge of the upper horizontal member 3, and a fitting groove 19, into which the seal member 18 is fitted, is formed in the edge of the lower horizontal member 6.

Let $L_1$ be the length in which the pin 11 is superposed on the bracket 13 (the length of the pin 11 projected from the bracket 13), $L_2$ the length in which the hook 17 and supporting member 15 are fitted (the length of the downwardly-directed groove 16 of the hook 17), and $L_3$ the length in which the seal member 18 and fitting groove 19 are fitted, then the relation of $L_1 > L_2 > L_3$ is established.

That is, it is designed so that when the curtain wall unit $A_2$ is pulled up and then pulled down from the top of the existing curtain wall unit A positioned therebelow, the pin 11 is first fitted into the bracket 13, the hook 17 is then fitted into the supporting member 15, and finally the fitting groove 19 is fitted into the seal member 18.

In the following, various parts will be described in detail.

Figure 3:
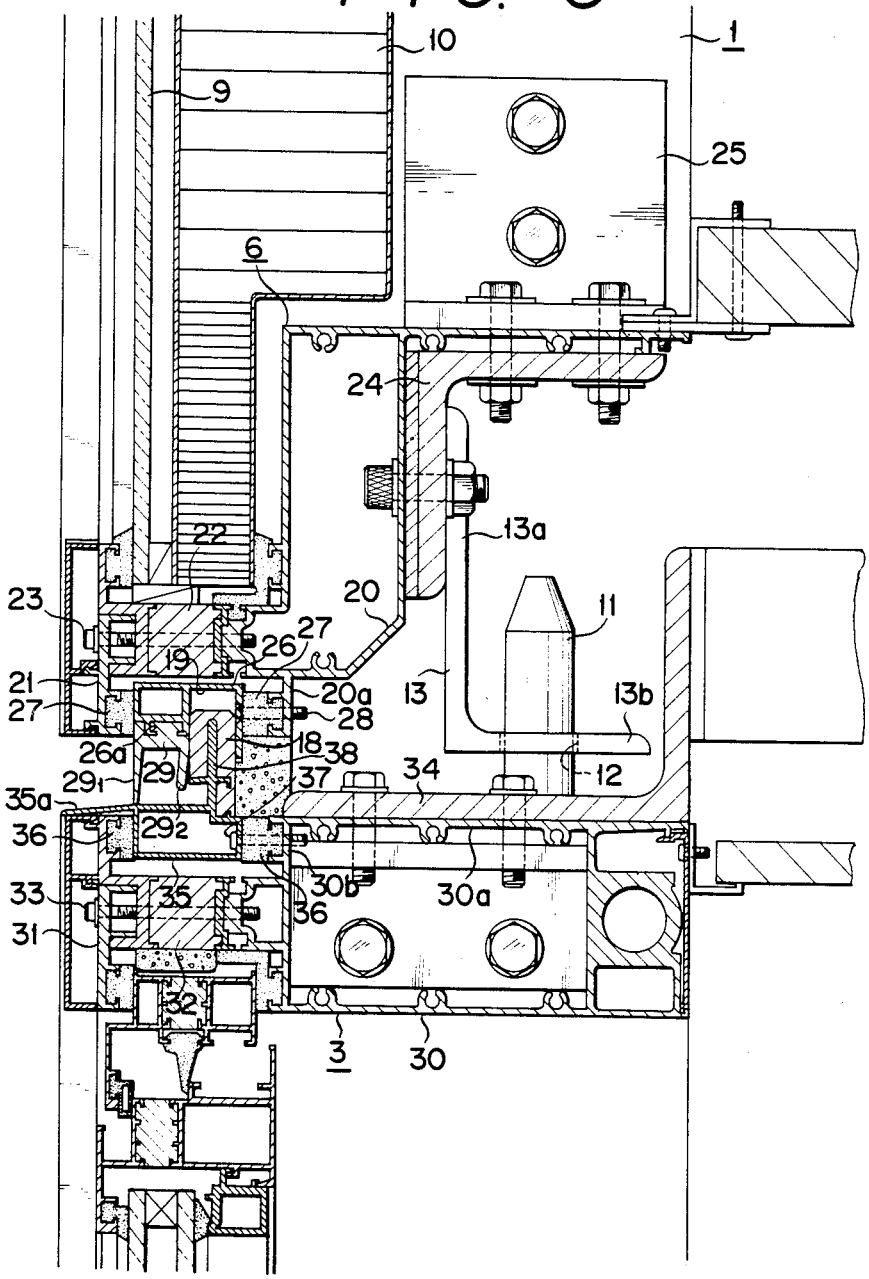
FIGS. 3 and 4 are details of III portion and IV portion, respectively, of FIG. 2 in an enlarged scale.

FIG. 3 illustrates the detail of III portion of FIG. 2. The lower horizontal member 6 is one in which a pressing edge member 21 is connected to a body 20 by means of a bolt 23 through a heat insulating connector 22. The body 20 is secured to the mullion 1 through fittings 24 and 25 and a longitudinal member **13*a* of the bracket 13 is secured to the body 20. The hole 12 as an engaging portion is formed in a horizontal member 13*b*, said hole 12** comprising an elongated hole in a direction parallel to a curtain wall surface so that adjustment in phase in the direction parallel to the curtain wall surface may be made.

A frame member 26 is fitted between the body 20 and the pressing edge portion 21 through heat insulting packings 27, 27 and secured to an suspension wall **20*a* of the body by means of a screw 28, the fitting groove 19 is formed internally of the room of the frame 26, and a downwardly-directed recessed groove 26*a* is formed externally of the room, the downwardly-directed recessed groove 26*a* having an auxiliary seal memeber 29** mounted thereon.

The upper horizontal member 3 has the shape in which a pressing edge member 31 is connected to a body 30 by means of a bolt 33 through a heat insulating connector 32. The pin 11 is upwardly secured to an upper wall **30*a* of the body 30 through an L-shaped fitting 34, a frame 35 is fitted between the body and the pressing edge member 31 through heat insulating packings 36 and 36 and secured to a side wall 30*b* externally of the room of the body 30 by means of a screw 37, and an upper wall 35*a* of the frame 35 extends externally of the room to cover the upper portion of the upper horizontal member 3, the upper wall 35*a* being integrally formed with a riser 38, said riser 38 having the seal member 18** fitted therein.

The auxiliary seal member 29 is provided with a first seal piece $29_1$ in abutment with an upper wall **35*a* of the frame and a second seal piece $29_2$ in pressure contact with the seal member 18** to enhance watertightness between upper and lower connecting portions.

Figure 6:
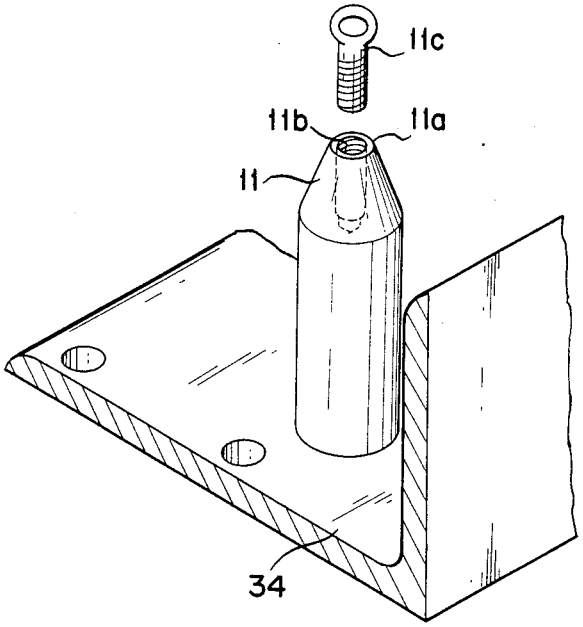
FIG. 6 is a perspective view showing a further embodiment of a projecting member.

It will be noted that as shown in FIG. 6, a pin 11 can be formed at its end surface **11*a* with a threaded hole 11*b*, into which a hook 11*c*** is threadedly fitted to serve as a wire catch used when the curtain wall unit is pulled up.

Figure 4:
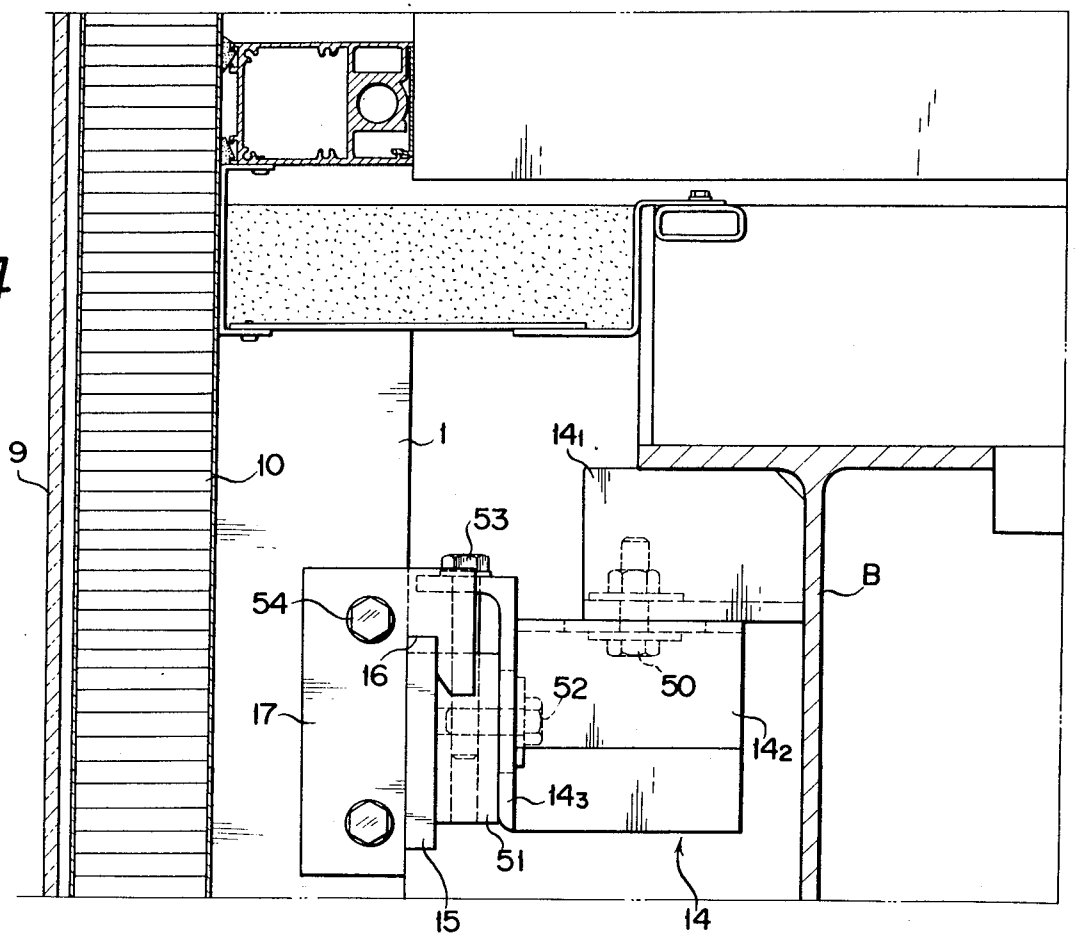

FIG. 4 illustrates the detail of IV portion indicated in FIG. 2. A first fastener $14_1$ is welded and secured to the building body B, a second fastener $14_2$ is secured to the first fastener $14_1$ in such a way that it may be adjusted movably in all directions by means of a bolt and nut 50, a third fastener $14_3$ is welded and secured to the second fastener $14_2$, a block 51 secured to the supporting member 15 is secured to the third fastener $14_3$ in such a way that it may be adjusted movably up and down by means of a bolt 52, a height adjusting bolt 53 is threadedly fitted into the block 51 from the third fastener, and the hook 17 is secured to the mullion 1 by means of a bolt 54.

It will be noted that the hook 17 can be formed integral with the mullion 1.

Figure 5:
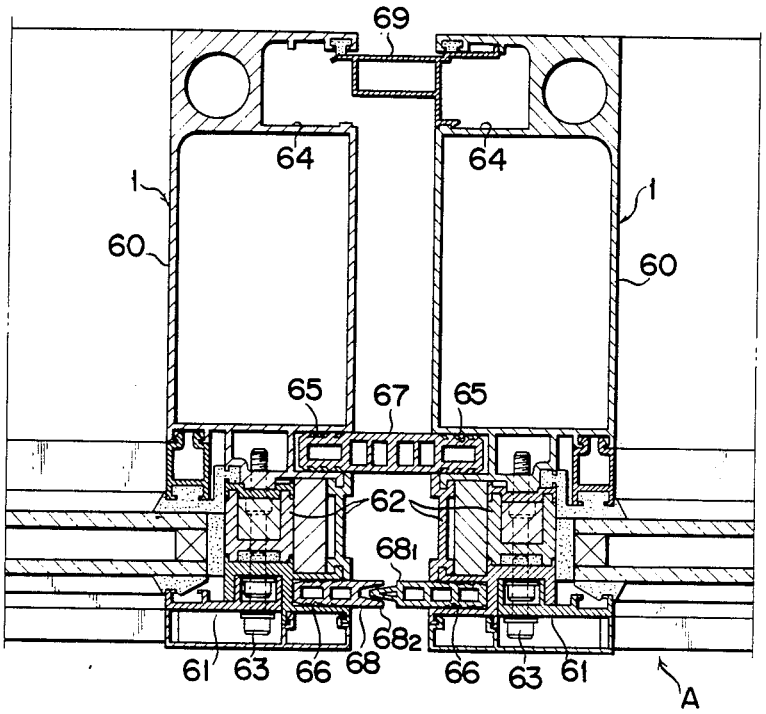
FIG. 5 is a detailed sectional view taken on line V—V of FIG. 1.

FIG. 5 illustrates the detail in section taken on line V—V of FIG. 1. The mullion 1 has the shape in which a pressing edge member 61 is connected to a body 60 through a heat insulating connector 62 by means of a bolt 63. An outwardly-directed recess portion 64 is formed internally of the room of the body 60, a laterally-directed recessed groove 65 is formed externally of the room, and a laterally-directed recessed groove 66 is formed in the pressing edge member 61.

A clearance-concealing attachment 69 is mounted between laterally-directed recesses 64 and 64 of the mullions 1 and 1 adjacent to left and right, packing bands 67 and 68 internally and externally of room are fitted and connected between the laterally-directed recessed grooves 65 and 66, and thus the mullions 1 and 1 adjacent to left and right are connected relatively displaceably in the direction parallel to the curtain wall surface.

It will be noted that the packing band 68 externally of room has the shape in which a first and a second packing bands $68_1$, $68_2$ are connected in abutment relation.

Next, the method of mounting curtain wall units will be described in connection with FIG. 7 and FIGS. 1 through 5.

First, the curtain wall units A are successively mounted in a lateral direction along the lower member C to assemble the lowermost curtain wall unit row $D_1$, and thereafter the curtain wall units A are successively mounted to left and right above the lowermost curtain wall unit row $D_1$ to assemble a second curtain wall row $D_2$.

Figure 7:
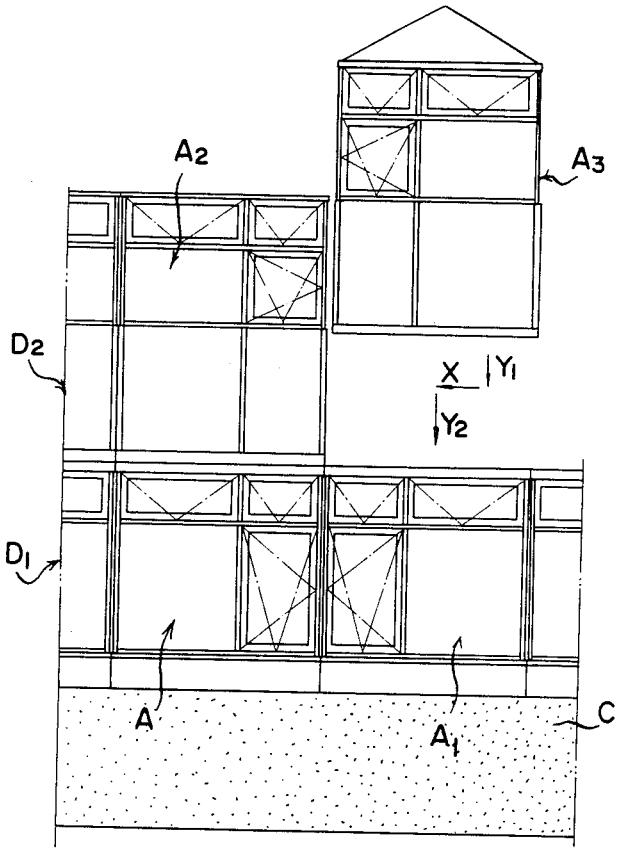
FIG. 7 is a schematic illustration for explaining the mounting method in accordance with the present invention.

FIG. 7 shows the state wherein a suitable curtain wall unit $A_3$ of the second curtain wall unit row $D_2$ is mounted on the existing curtain wall unit $A_1$ positioned therebelow and the existing curtain wall unit $A_2$ positioned to left or right, and the mounting method will be described in order.

First, in the state wherein the packing band $68_1$ externally of the first room is mounted on one mullion 1 of the curtain wall unit $A_3$ and the packing band 67 internally of room, the packing band $68_2$ externally of the second room and the clearance-concealing attachment 69 are mounted on the other mullion 1 of the existing curtain wall unit $A_2$, and the curtain wall unit $A_3$ is pulled up by means of a crane or the like.

Then, the unit $A_3$ is moved down (in the direction as indicated by arrow $Y_1$) towards the existing curtain wall unit $A_1$ positioned therebelow, and the hole 12 of the bracket 13 is slightly fitted into the pin 11 to position the upper horizontal member 3 (i.e., the upper edge) of the lower existing curtain wall unit $A_1$ and the lower horizontal member 6 (i.e. the lower edge) of the curtain wall unit $A_3$ to be mounted in the direction orthogonal to the curtain wall surface.

Then, the curtain wall unit is further moved downwardly guided by the pin 11 and hole 12, and the hook 17 and supporting member 15 are slightly fitted for effecting positioning even by the hook 17 and supporting member 15 in the direction orthogonal to the curtain wall surface. At that time, the seal member 18 and fitting groove 19 are not fitted.

Thereafter, the curtain wall unit $A_3$ to be mounted is moved leftwards (as indicated by arrow X) in the direction orthogonal to the curtain wall surface guided by the pin 11, the elongated hole 12 and supporting member 15, and the hook 17 so as to be fitted into the packing band 67 internally of room mounted on the other mullion of the existing curtain wall unit $A_2$ positioned to left or right, the laterally-directed recessed groove 65 of the curtain wall unit $A_3$ to be mounted on the clearance-concealing attachement 69 and the outwardly-directed recess 64. And the packing band $68_1$ externally of the first room is connected to the packing band $68_2$ externally of the second chamber in an abutment relation to connect the existing curtain wall units $A_2$ positioned to left and right and the curtain wall unit $A_3$ to be mounted in the direction parallel to the curtain wall surface and to enhance the watertightness between the left and right connecting portions.

The curtain wall unit is further moved perpendicularly downwardly (as indicated by the arrow $Y_2$) to completely fit the hook 17 and supporting member 15 to rigidly secure the curtain wall unit $A_3$ to be mounted to the building body B, and the seal member 18 and fitting groove 19 are fitted to enhance the watertightness between the upper and lower connecting portions.

At this time, in the state wherein positioning in the direction orthogonal to the curtain wall surface is made by the pin 11, the hole 12 of the hook 13 and the hook 17, the seal member 18 and fitting groove 19 can be fitted and the seal member 18 and fitting groove 19 can be fitted without having the seal member bended or broken.

As described above, in the state wherein positioning in the direction orthogonal to the curtain wall surface is made, the curtain wall unit to be mounted is moved in the direction parallel to the curtain wall surface and connected to the existing curtain wall units positioned to left and right, and therefore, the connecting work can be carried out simply.

Moreover, after the curtain wall unit has been connected to the existing curtain wall units positioned to left and right, the unit is moved downwardly and the hook and supporting member 15 are fitted whereby the units are secured to the building body. Therefore, the securing work can be carried out simply.

I claim:

1. A construction of mounting curtain wall units comprising a mullion with front and back sides, hook means secured to said back side of said mullion constituting a curtain wall unit, a building body with a front surface, a supporting member secured to said front surface of said building body for engagement with said hook means, projecting member provided to be projected upwardly spaced apart from each other on an upper edge portion of the curtain wall unit and a seal member, a lower edge portion of the curtain wall unit having a groove at a position corresponding to said seal member and engaging therewith, and bracket means secured to said lower edge portion of the curtain wall unit, an engaging portion of said bracket means formed at a position corresponding to said projecting member and engaging therewith, characterized in that said projecting member and seal member provided on the upper edge portion of a lower one of a pair of vertically adjacent curtain wall units are respectively engaged with the engaging portion of said bracket provided on the lower edge portion of the upper unit and the groove of the lower edge portion, said hook means being engaged with said supporting member wherein said engaging portion formed in the bracket secured to the lower edge portion of the curtain wall unit comprises an elongated hole extending in a direction parallel to the curtain wall surface, whereby the curtain wall unit to be mounted is moved in a direction parallel to the curtain wall surface.

* * * * *